US005848544A

United States Patent [19]

Brioschi et al.

[11] Patent Number: 5,848,544

[45] Date of Patent: Dec. 15, 1998

[54] APPARATUS FOR A BALANCED ADJUSTMENT OF THE ROLL POSITION IN STANDS WITH TWO WORKING ROLLS FOR LONGITUDINAL ROLLING MILLS

[75] Inventors: Roberto Brioschi, Milan; Maurizio Brignoli, Romano di Lombardia; Stefano Bandini, Milan, all of Italy

[73] Assignee: Innśe Innocenti Engineering Santeustacchio S.p.A., Milan, Italy

[21] Appl. No.: 769,034

[22] Filed: Dec. 17, 1996

[30] Foreign Application Priority Data

Jan. 9, 1996 [IT] Italy ..... MI96A0024

[51] Int. Cl.[6] ..... B21B 31/07

[52] U.S. Cl. ..... 72/245; 72/249

[58] Field of Search ..... 72/237, 238, 239, 72/240, 245, 247, 248, 241.2, 241.4, 249

[56] References Cited

U.S. PATENT DOCUMENTS

| | | | |
|---|---|---|---|
| 3,946,587 | 3/1976 | Maltby | 72/237 |
| 4,406,144 | 9/1983 | Bond et al. | 72/238 |
| 4,485,649 | 12/1984 | Martin et al. | 72/245 |
| 4,497,215 | 2/1985 | Gronbech et al. | 72/248 |
| 4,658,622 | 4/1987 | Haynes | 72/249 |
| 4,759,485 | 7/1988 | Braun et al. | 72/245 |
| 4,787,226 | 11/1988 | Haynes | 72/238 |
| 4,817,407 | 4/1989 | Alich | 72/245 |
| 4,912,956 | 4/1990 | Matricon et al. | 72/245 |
| 4,918,964 | 4/1990 | Engel et al. | 72/238 |
| 5,448,901 | 9/1995 | Yu et al. | 72/247 |

*Primary Examiner*—Joseph J. Hail, III
*Assistant Examiner*—Rodney Butler
*Attorney, Agent, or Firm*—Panitch Schwarze Jacobs & Nadel, P.C.

[57] ABSTRACT

An apparatus is described for adjusting the position of rolls (9) in stands with two working rolls for longitudinal rolling mills, in particular for rolling seamless tubes, with hydraulic capsule directly connected to the chock (8) of each roll bearing, wherein said capsule comprises a movable piston (2) and stationary parts (1, 3). At one end of said piston (2) there is provided a shaped axial element (12) for the engagement into a corresponding undercut groove (18) of said chock (8) to balance the own weights and take up the end plays along the capsule axis. Such an apparatus is preferably associated with a device for detecting the relative position between piston (2) and stationary parts (1, 3) by means of a transducer (7) in an out-of-center position with respect to the axis.

7 Claims, 6 Drawing Sheets

APPARATUS FOR A BALANCED ADJUSTMENT OF THE ROLL POSITION IN STANDS WITH TWO WORKING ROLLS FOR LONGITUDINAL ROLLING MILLS

The present invention relates to the longitudinal rolling mills with two working rolls for each stand, usually employed, although not exclusively, for manufacturing seamless tubes and in particular is directed to an apparatus for a balanced adjustment of the position of these rolls.

It is known that in the last years the rolling plants of the above-mentioned type have been substantially modified in their design, especially by the adoption of adjustment devices based on the use of hydraulic capsules which can cause the axis of the working rolls to move away or approach the rolling axis, that is stationary in this type of machines. Such an adjustment is required for example, to compensate for the diameter reductions due to either the rolls wearing or to the profile turning operations carried out to restore the original profile of the roll, as well as to compensate for the variation of the dimension obtained by adding the chock height to the roll radius due to variation of either the inner diameter of the tube, in case of tube manufacturing, or the thickness of a flat product. Furthermore, still in the case of seamless tubes, it should be appreciated the variation of position of the rolls acting onto the same inner tool or mandrel to obtain different thicknesses as well as the roll position under load is required to be controlled to obtain a better result as to the product quality (for example: compensation for elastic yields, thermal variations and changes of shape at the end of the tubes or compensations for the possible taper of the mandrel). Also the need of providing for emergency openings of the rolls should be taken into account, should the product (tube or others) jam inside of the stand, as well as the case in which the rolls are to be replaced.

In a first attempt to solve this technical problem, the large electromechanical screw traditionally used to adjust the position of each roll has been operatively coupled with a hydraulic capsule having a relatively short stroke (25 mm at maximum) placed between the screw and each chock of the roll, i.e. the bearing holder on which the capsule rests, directly or indirectly, through devices for taking up possible misalignments. However, since this solution involved the need of installing flexible conduits for feeding with oil the two chambers of the capsule, with consequent worsening and unreliability of the dynamic control characteristics, when considering that each stand requires four capsules (two for each roll), such a solution has been recently dropped by adopting completely hydraulic rolling mills in which the large screws have been definitively replaced with capsules being capable of considerably longer strokes, between 50 and 100 mm.

It is also known that, as shown in FIG. 1 relating to the prior art, the device which has the task of ensuring the contact between chock and piston of a hydraulic capsule is fixedly mounted on board of the stand, but necessarily offset from the symmetry axis of the capsule. In fact, FIG. 1 shows two cylinders A of lateral balancing, represented in two different situations of adjustment with respect to the rolling axis; in this case they are positioned externally with respect to the axis of the two capsules acting on a roll and therefore the action of one of the balancing cylinders has the tendency to oppose the action of the other one. On the other hand, when also the weight loading the chocks is considered, due to the so-called "spindles" B being provided on only one side of the rolls, as shown in FIG. 2, also illustrating the above-indicated prior art solution, there is the possibility that a chock rotation may occur with consequent danger for the regular operation of the rolling mill.

Therefore an object of the present invention is that of providing an apparatus for adjusting the position of the rolls by means of hydraulic capsules in the stands with two working rolls for rolling mills of the above-mentioned type such that the adjustment control is caused to occur through axial balancing, along the symmetry axis of the capsule, thus avoiding at the same time the need of flexible conduits for feeding the cylinders controlling the balancing itself.

These and additional objects of the present invention are achieved by means of an apparatus having the features of claim 1.

According to a particular aspect of the present invention, at the same time there is provided a device for detecting at any moment the relative position between movable piston and stationary parts of the capsule by means of a transducer the position of which is obviously offset with respect to the piston axis, but however without particular inconveniences caused thereby.

Additional objects, advantages and features of the apparatus according to the present invention will become clearer from the following description given by way of a non-limiting example with reference to the annexed drawings in which.

Figure 3:
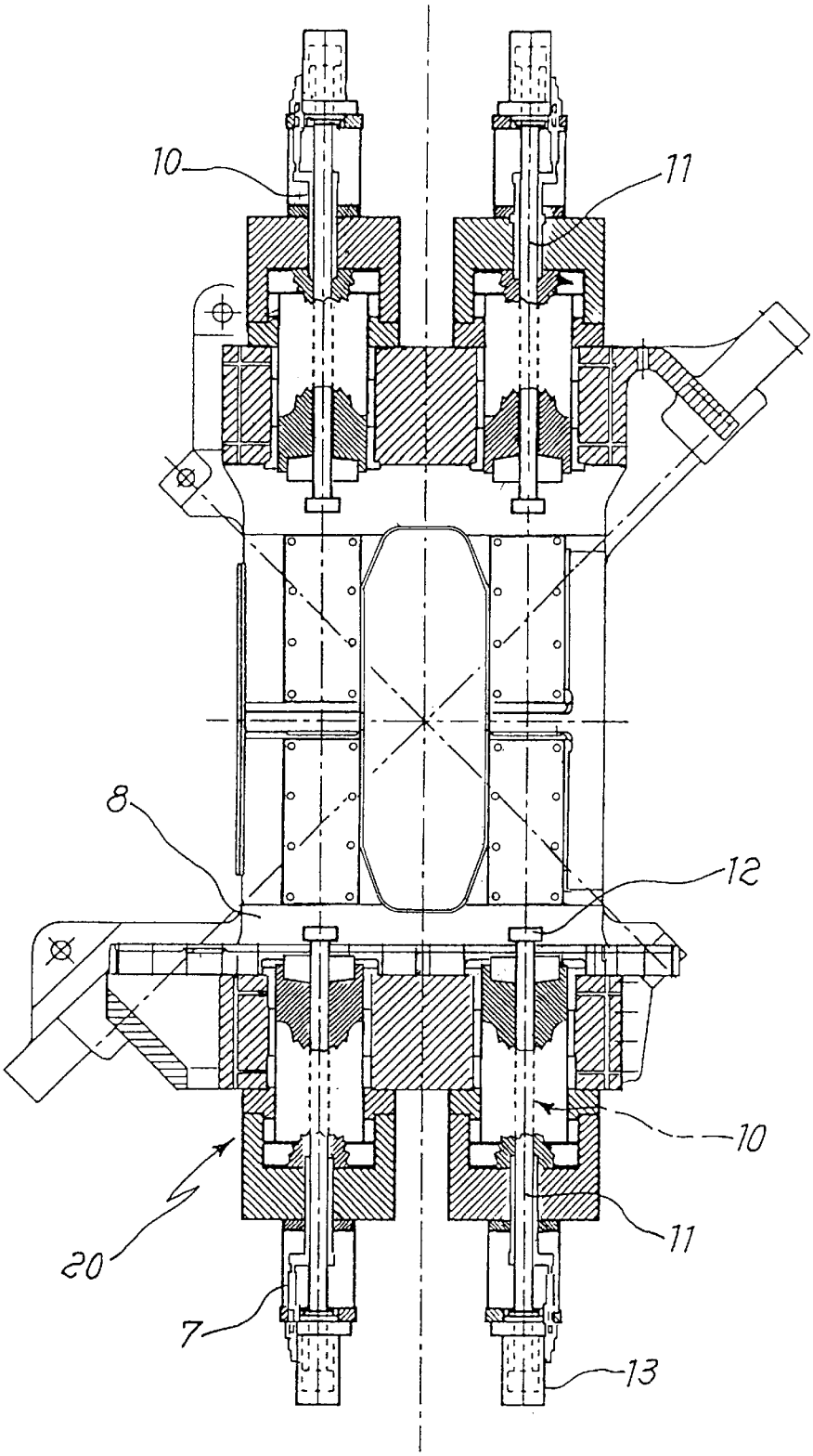
FIG. 3 shows a sectional view of a two-rolls stand of the above-mentioned type being provided with the adjustment apparatus with axial balancing according to the present invention.
Figure 5:
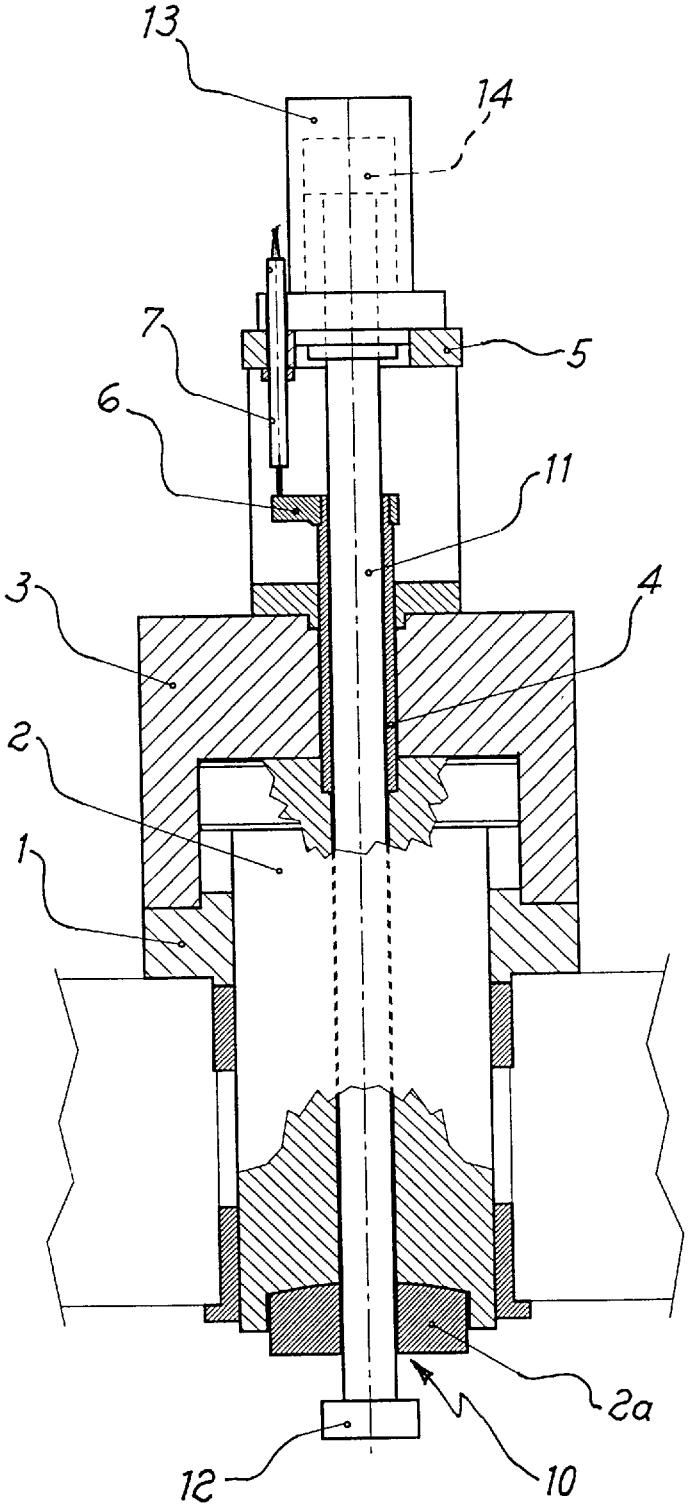
FIG. 5 shows a sectional view of a hydraulic capsule for the stand of FIG. 3, with adjustment apparatus according to the present invention.

With reference to the drawings, it is known that the hydraulic capsules 20 each having it's own longitudinal axis 21, in number of four for each stand (two for each roll) as is seen in FIG. 3, are formed, with reference to FIG. 5, of a stationary portion comprising a flange 1 and members 3 and 5, as well as a mobile portion comprised of members 2, 4 and 6. Both the stationary and mobile members will be better described in the following. The relative motion between the two parts is obtained by feeding or discharging oil from the two chambers in which piston 2 divides the inside of capsule 20. The adjustment of the position is obtained, like in the prior art, by means of servo-valves (not shown) being controlled through systems for detecting the linear position, indicated with number 7 in FIG. 5, and usually formed as position transducers of electronic type.

Figure 4:
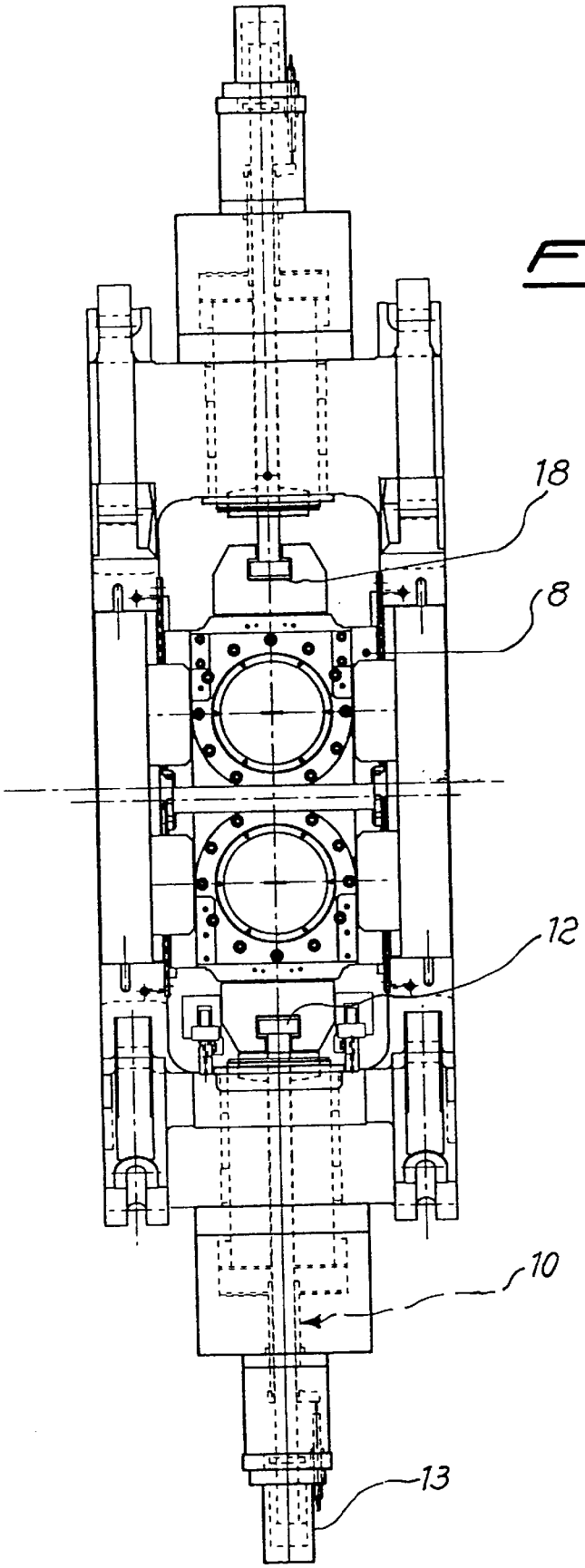
FIG. 4 shows a view similar to that of FIG. 1 for a stand according to FIG. 3 with adjustment apparatus of the invention.
Figure 6:
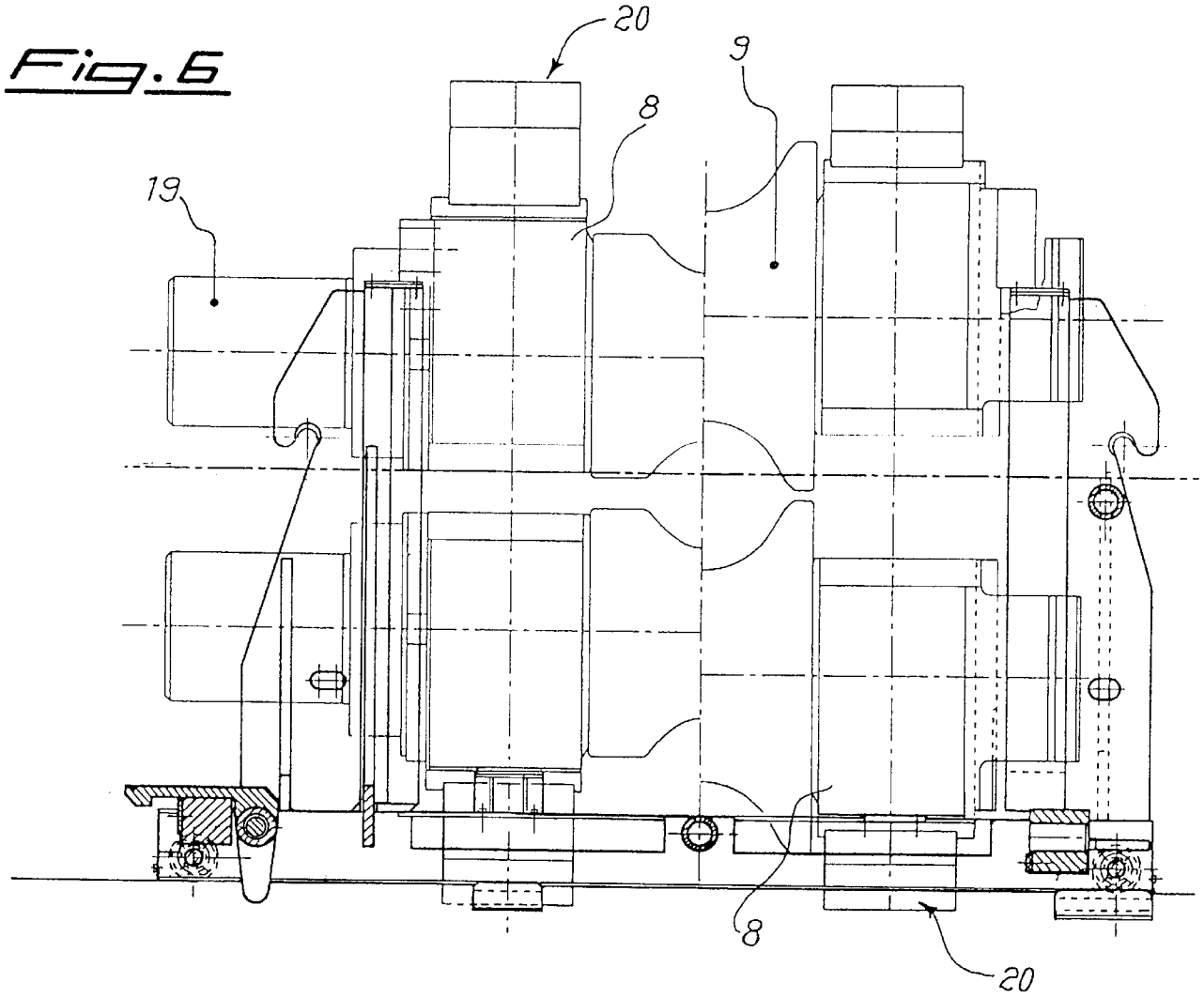
FIG. 6 shows a further diagrammatic partial view of the rolls of a stand according to FIG. 3, in two different adjustment positions.

According to the present invention, an apparatus 10 has been associated, co-axially with the piston 2, to the group comprising capsule and position transducer, for maintaining the contact between piston bottom 2*a* and head 18 of the chock 8 supporting the bearing (not shown) about which the working roll 9 rotates (FIGS. 4 and 6).

The balancing apparatus 10 mainly comprises a tie rod 11 slidable mounted within the piston 2. A member 12 is integrally connected to an end of the tie rod 11 and is shaped in whichever known way (like a mushroom, dovetail, hammer-head etc.) for engaging a corresponding undercut groove formed in the head 18 of said chock 8. The mutual engagement is carried out laterally similarly to the disengagement of member 12, as also in a lateral direction the chocks 8 are removed, such as in case of replacement of the roll, while any axial movement of the piston 2 is directly transmitted to the chock 8.

At the opposite end of the member 12, the tie rod 11 which has crossed the mobile piston 2 gets out from the stationary portion 3 of the capsule across a co-axial sleeve 4 fixedly mounted to the piston. Said tie rod is moved by the control rod 14 of a stationary hydraulic control cylinder 13 (see FIG. 5). Since the control cylinder 13 is stationary, there is no need of flexible feed tubes.

In addition to the function of guiding the tie rod 11, the sleeve 4 has also the function of supporting a mobile flange 6 which allows to detect, through a transducer 7, the relative position between piston 2 and stationary parts 1, 3 of the capsule, thanks to a stationary element 5 which is fixedly mounted to the stationary portion 3. From FIG. 5, the position of transducer 7 clearly appears to be offset with respect to the axis of piston 2, since the position co-axial with the latter is occupied by the balancing apparatus 10, in particular the tie rod 11 with its hydraulic control cylinder. Furthermore the transducer 7 is comprised of at least two portions, one of which stationary and one mobile, which are respectively integral with the stationary flange 5 and mobile one 6.

It is obvious that owing to the oil pressure existing in the two chambers of the capsule, which can reach up to 35 Mpa, all the parts having a relative movement therebetween are provided with suitable sealed gaskets of known type. Thus the capsules having the adjusting device according to the invention can have strokes of considerable length, up to about 200 mm, sensibly higher than the values which have been previously indicated for the prior art.

Figure 1:
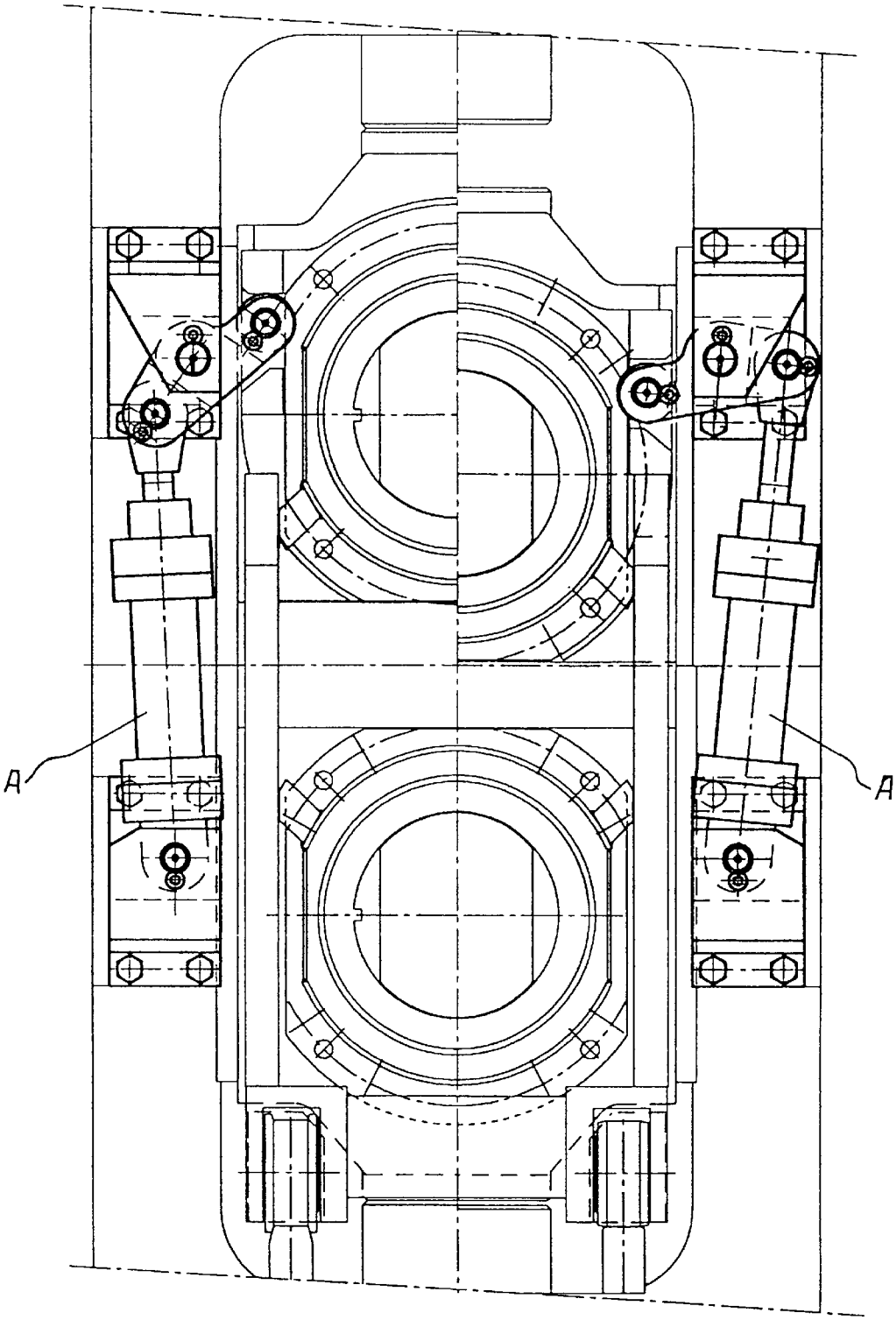
FIGS. 1 and 2 show two cross-section diagrammatic views, perpendicular to each other and to the lamination axis, of a stand for continuously rolling tubes with adjustment device including hydraulic capsules according to the prior art previously discussed.
Figure 2:
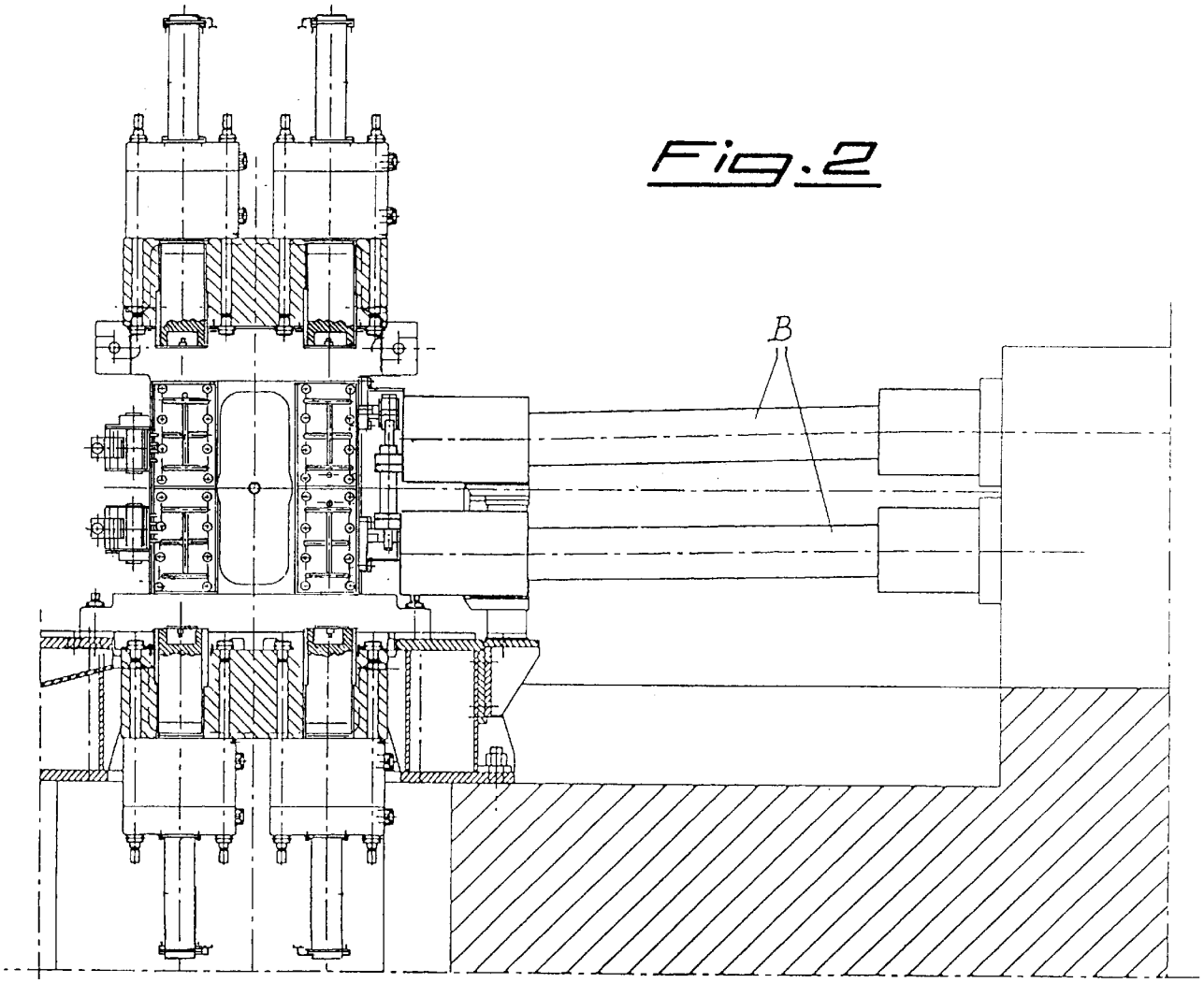

It is a clear consequence of the foregoing that the mechanisms for adjusting the position of the rolls can, with the apparatus of the present invention, be concentrated in well restricted zones of the stand, thus simplifying the practical operations while working and also reducing the risks of damages during the working steps. Through the engagement of shaped member 12 into the groove 18, also the contact between piston 2 and chock 8 is optimized thus avoiding possible malfunctions or damages. It should also be appreciated that rolls 9 are driven each by means of an appendage 19 (see FIG. 6) which is in engagement, through a joint, with a so-called driving "spindle" of known type. Said spindles are not represented in FIG. 6 but it is clear that owing to the axial balancing of this solution they do not produce the possible rotations of the chocks as mentioned above for the prior art with reference to FIG. 2.

As stated before, the use of hydraulic capsules with integrated balancing according to the present invention is possible on rolling mills having two working rolls for each stand, also for products different from tubes, such as metal sections, round billets, rod-shaped bodies, etc. In case of similar tubes it will be noted that, like for the conventional stands, the orientation of the stands provided with the apparatus of the present invention can be either with horizontal and vertical orientation for two stands in succession, or with a 45°-orientation, but in any case with subsequent stands angled at 90°. Therefore the distribution of the static loads to be balanced is rather various, even within a single rolling mill, but the proposed solution allows working however in the best conditions, thus having therefore a further advantage with respect to the prior art with hydraulic capsules being provided with an out-of-axis balancing.

Possible additions and/or modifications can be brought by those skilled in the art to the above-described and illustrated embodiment of the apparatus of the present invention without departing from the scope of the invention itself. In particular different shapes of the engagement member 12 can be foreseen, to which of course a complementary shape of the groove 18 in the chock head will correspond.

We claim:

1. An apparatus for use in longitudinal rolling mills with stands having two working rolls, for adjusting the position of the rolls by utilizing a hydraulic capsule directly coupled to a chock, each chock supporting a bearing of each roll, said capsule comprising:

a mobile piston having a longitudinal axis;

stationary parts; and a tie rod, slidably mounted to and passing through the longitudinal axis of said piston, wherein at an end of said tie rod there is fixedly mounted an axial member for engagement in a corresponding undercut groove of said chock to balance the rolls and the weight of the chock and to take up chock and piston end play along the piston longitudinal axis, said tie rod extending out of the capsule through a stationary portion of the stationary parts of the capsule by passing through a co-axial guide sleeve integral with the piston, said stationary portion being located on an opposite side of the hydraulic capsule with respect to said axial engagement member.

2. An apparatus according to claim 1, wherein said tie rod is moved by a control rod of a stationary hydraulic control cylinder.

3. An apparatus according to claim 1, wherein the mutual engagement between said axial member and said chock is obtained through a relative movement in a lateral direction.

4. An apparatus according to claim 1 further comprising a transducer which is offset with respect to the piston axis for detecting the relative position between the piston and the stationary parts of the capsule.

5. An apparatus according to claim 4, wherein said transducer comprises at least two parts, one of which is stationary and fixedly mounted to a stationary element being in turn integral with said stationary portion, and a mobile portion which is integral with a mobile flange which in turn is integral with said co-axial guide sleeve.

6. An apparatus according to claim 2, further comprising a transducer which is offset with respect to the piston axis for detecting the relative position between the piston and the stationary parts of the capsule.

7. An apparatus according to claim 3, further comprising a transducer which is offset with respect to the piston axis for detecting the relative position between the piston and the stationary parts of the capsule.

* * * * *